US010967498B2

(12) United States Patent
Lee et al.

(10) Patent No.: US 10,967,498 B2
(45) Date of Patent: Apr. 6, 2021

(54) DISPLAY STRUCTURE FOR WRENCH

(71) Applicants: Tsan-Chang Lee, Taichung (TW); Chiou-Mai Chang, Taichung (TW)

(72) Inventors: Tsan-Chang Lee, Taichung (TW); Chiou-Mai Chang, Taichung (TW)

( * ) Notice: Subject to any disclaimer, the term of this patent is extended or adjusted under 35 U.S.C. 154(b) by 339 days.

(21) Appl. No.: 16/175,873

(22) Filed: Oct. 31, 2018

(65) Prior Publication Data

US 2020/0130166 A1 Apr. 30, 2020

(51) Int. Cl.

| | |
|---|---|
| ***B25G 1/10*** | (2006.01) |
| ***G09F 7/16*** | (2006.01) |
| ***B25B 13/08*** | (2006.01) |
| ***B25B 13/04*** | (2006.01) |

(52) U.S. Cl.

CPC ..... *B25G 1/105* (2013.01); *G09F 7/165* (2013.01); *B25B 13/04* (2013.01); *B25B 13/08* (2013.01)

(58) Field of Classification Search

CPC ..... B25B 13/04; B25B 13/08; B25G 1/105; G09F 7/16; G09F 7/165

See application file for complete search history.

(56) References Cited

U.S. PATENT DOCUMENTS

| | | | | |
|---|---|---|---|---|
| 5,079,978 | A * | 1/1992 | Kupfer | B25B 13/56 206/376 |
| 7,387,052 | B2 | 6/2008 | Chang | |
| 7,418,893 | B2 * | 9/2008 | Hu | G09F 3/00 81/177.1 |
| 8,701,524 | B2 | 4/2014 | Chang | |
| D727,699 | S * | 4/2015 | Chen | B25B 23/16 D8/27 |
| 9,272,402 | B2 * | 3/2016 | Hu | B25B 23/16 |
| 2004/0216566 | A1 * | 11/2004 | Shih | B25B 13/56 81/119 |
| 2006/0027054 | A1 * | 2/2006 | Wang | G09F 7/165 81/180.1 |
| 2008/0302216 | A1 * | 12/2008 | Hu | B25B 13/06 81/121.1 |

* cited by examiner

*Primary Examiner* — David B. Thomas

(57) ABSTRACT

A display structure for a wrench includes a handle which includes a mirror surface or a matte surface. At least one display area is formed in the handle and is a recessed area in which at least two embossed areas and at least one blank area are formed. At least one display portion is formed within the at least one display area. The at least one display portion has a colored area formed on the top thereof, so that the at least one display portion has a color that is different from that of the body of the wrench.

9 Claims, 6 Drawing Sheets

DISPLAY STRUCTURE FOR WRENCH

BACKGROUND OF THE INVENTION

1. Fields of the Invention

The present invention relates to a display structure for a wrench.

2. Descriptions of Related Art

The conventional display structure of a wrench 20 is disclosed in FIG. 11, and the surfaces of the wrench may be a mirror surface or a matte surface. The wrench 20 includes a handle 21 and two function ends are formed on two ends of the handle 21. A display area 22 is formed in the handle 21 and includes characters, logos or patterns. When the surface of the wrench is a mirror surface, the second handle 21 and the display area 22 are mirror surfaces. On the contrary, when the surface of the wrench is a matte surface, the second handle 21 and the display area 22 are matte surfaces.

However, the width of the display area 22 is smaller than the width of the handle 21 of the wrench 20 so that the features of display is not satisfied, especially in a dim working site, such as the wrench is used in an engine room, the users are difficult to see the specifications in the display area 22 of the wrench 20.

The mirror surface lack sufficient friction so that the users are difficult to grip the wrench 20 firmly.

The characters or the patterns are pressed to be formed in the display area 22, so that when the molds for pressing the characters or the patterns may be dulled after a period of use, surplus material may be attached to the characters or the patterns. U.S. Pat. Nos. 7,387,052 and 8,701,524 disclose similar display structures.

The present invention is intended to provide a display structure for a wrench, and the display structure is more distinguishable.

SUMMARY OF THE INVENTION

The present invention relates to a display structure for a wrench and comprises a body having a handle which includes a top face and a bottom face, wherein the top face and the bottom face can be a flat face or a curved and protruded face. The top face and the bottom face are a mirror surface or a matte surface. The handle has at least one display area which is a recessed area in which at least two embossed areas and at least one blank area are formed. The at least one blank area is located between the at least two embossed areas. The top of each of the at least two embossed areas is not higher than the top face and the bottom face of the body. The at least one blank area is located at the central portion of the at least one display area. The top of the at least one blank area is lower than the top of each of the at least two embossed areas, and the top face and the bottom face of the body. At least one display portion is formed within, the at least one display area. The color of the at least one display portion is different from that of the body. The at least one display portion has a colored area formed on the top thereof. The color area of the at least one display portion is in flush with or is higher than the top face and the bottom face of the body. The colored area is formed by way of painting, transfer-printing, printing, applying fluorescent agent or laser carving. The at least one display portion is in a form of characters, logos, digits or patterns. The top of the at least one display portion is higher than the top of each of the at least two embossed areas.

The advantages of the present invention are that the wrench is more distinguishable by the different colors of the display portion and the body. There are embossed areas, blanks and display portions on the wrench to provide different visual features.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figures 1, 2:
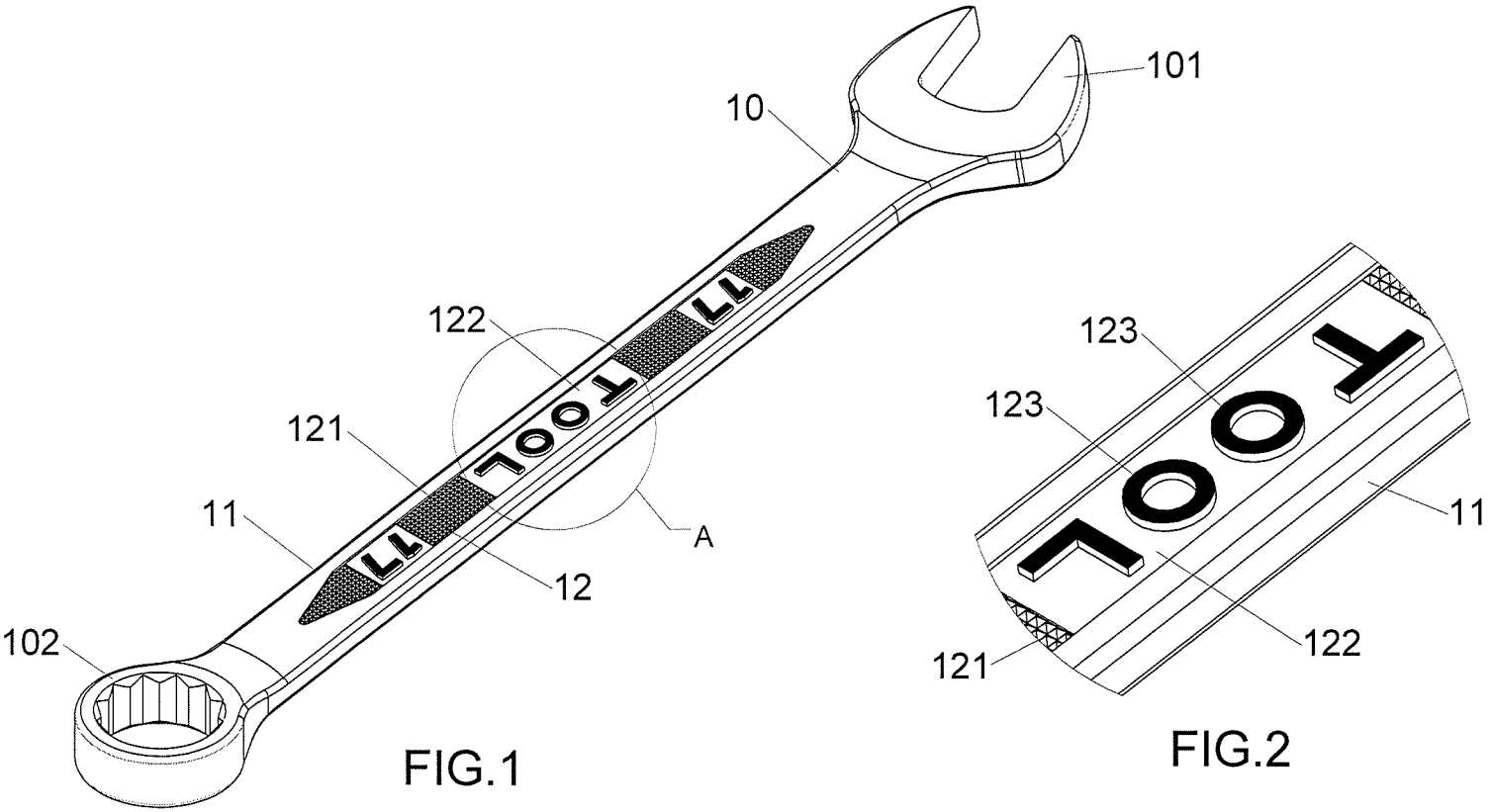
FIG. 1 is a perspective view to show the wrench with the display structure of the present invention.
FIG. 2 is an enlarged view of the circled area "A" in FIG. 1.

Referring to FIGS. 1 and 2, the display structure for a wrench of the present invention comprises a body 10 having a handle 11 which includes a top face and a bottom face. The top face and the bottom face is a flat face or a curved and protruded face. The top face and the bottom face is a mirror surface or a matte surface. A first function end 101 and a second function end 102 are respectively formed on two ends of the handle 11. In this embodiment, the first function end 101 is an open end, and the second function end 102 is a box end.

The handle 11 has a display area 12 which is a recessed area in which two embossed areas 121 and one blank area 122 are formed. The blank area 122 is located between the two embossed areas 121. The embossed areas 121 each include multiple small protruded portions or bosses. The top of each of the embossed areas 121 is not higher than the top face and the bottom face of the body 10. The blank area 122 is located at the central portion of the display area 12. The top of the blank area 122 is lower than the top of each of the two embossed areas 121, and the top face and the bottom face of the body 10. At least one display portion 123 is formed within the display area 12. The color of the at least one display portion 123 is different from that of the body 10. The at least one display portion 123 has a colored area formed on the top thereof, wherein the color area of the at least one display portion 123 is in flush with or is higher than the top face and the bottom face of the body 10. The colored area is formed by way of painting, transfer-printing, printing, applying fluorescent agent or laser carving. The at least one display portion 123 is in a form of characters, logos, digits or patterns. The top of the at least one display portion 123 is higher than the top of each of the two embossed areas 121.

Figure 4:
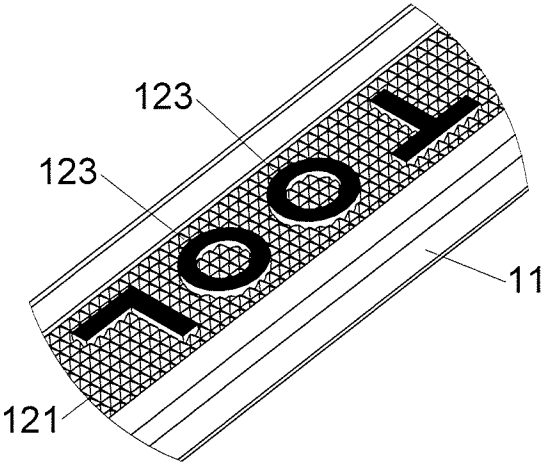
FIG. 4 is an enlarged view of the circled area "A" in FIG. 3.
Figure 3:
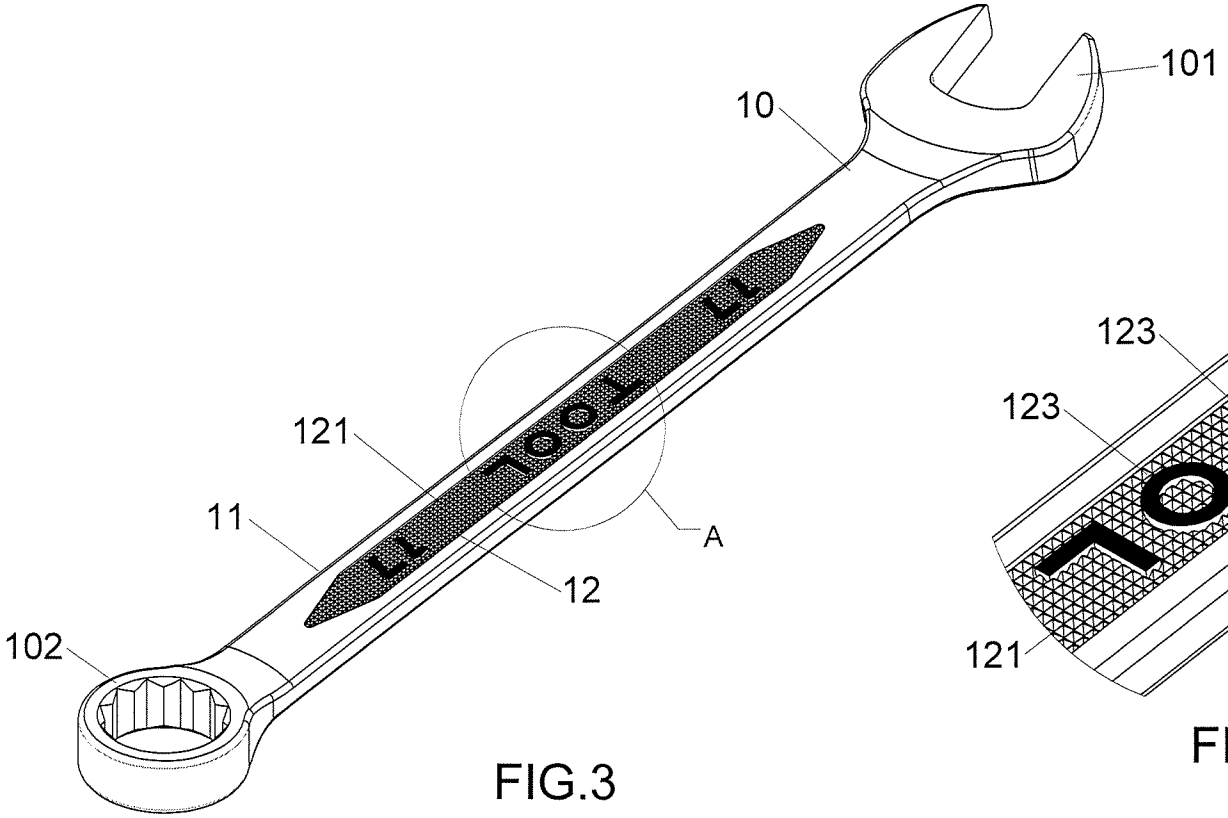
FIG. 3 shows the second embodiment of the display structure of the present invention.

As shown in FIGS. 3 and 4, the two embossed areas 121 cover up the display area 12 and fill the display area 12. The display portions 123 are spaced-apart from each other and located on the two embossed areas 121. Each of the display portions 1123 has the colored area formed on the top thereof.

Figure 6:
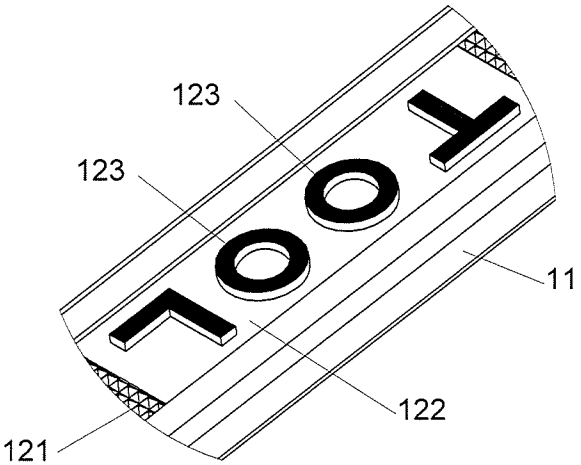
FIG. 6 is an enlarged view of the circled area "A" in FIG. 5.
Figure 5:
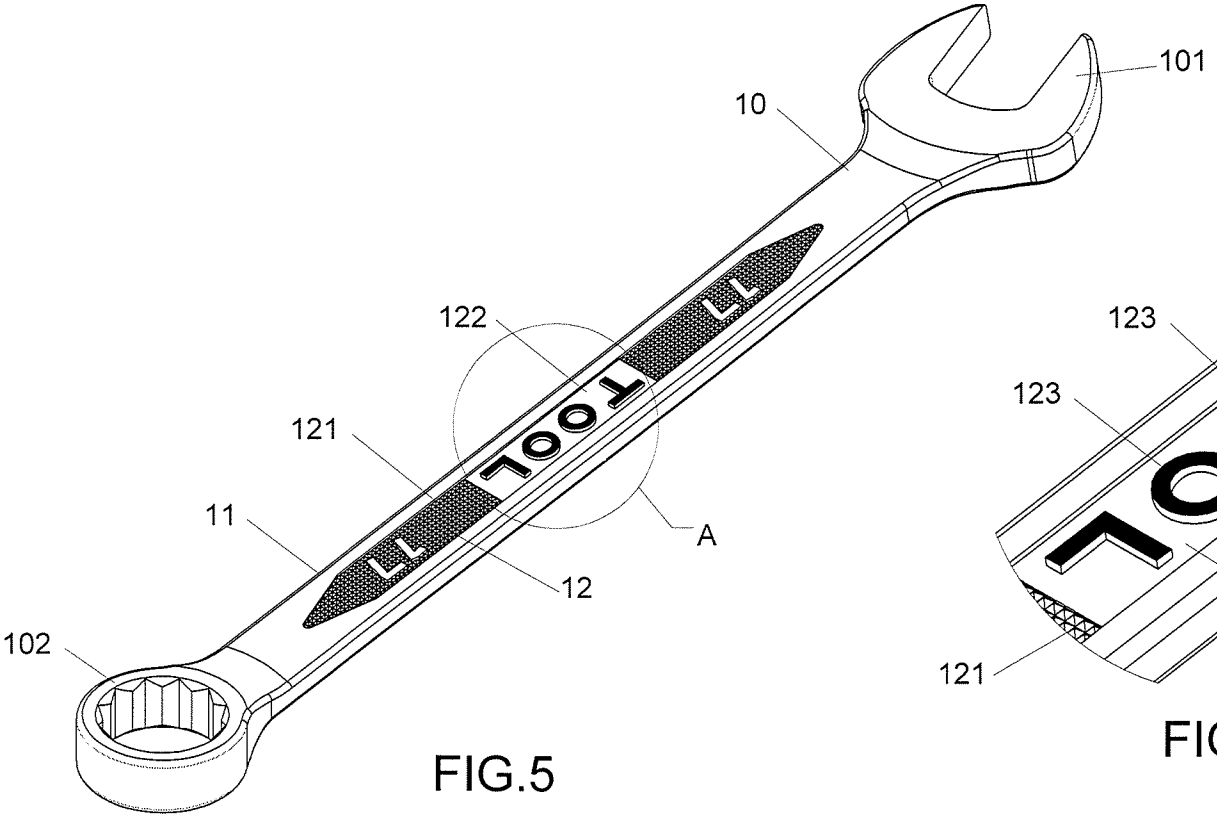
FIG. 5 shows the third embodiment of the display structure of the present invention.

As shown in FIGS. 5 and 6, there are four embossed areas 121 and three blank areas 122 in the display area 12. Each of the blank areas 122 has at least one of the display portions 123 located therein.

Figure 8:
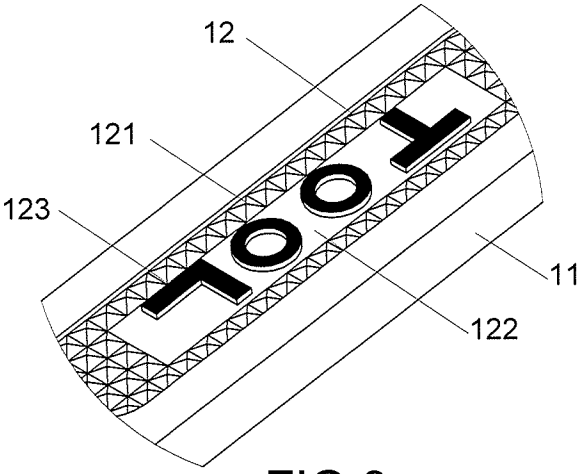
FIG. 8 is an enlarged view of the circled area "A" in FIG. 7.
Figure 7:
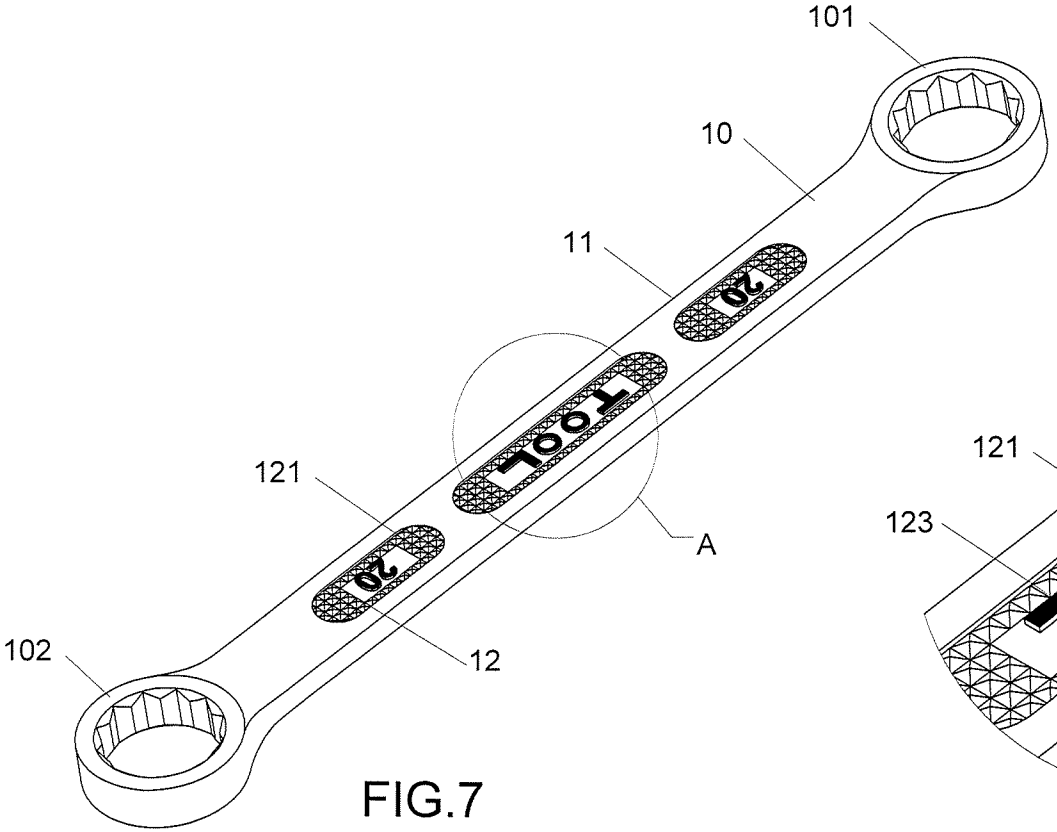
FIG. 7 shows the fourth embodiment of the display structure of the present invention.

As shown in FIGS. 7 and 8, the first function end 101 and the second function end 102 each are a box end. There are multiple display areas 12 which are spaced apart from each other and located on the handle 11. Each of the display areas 12 is an elongate recess in which the at least two embossed areas 121 and at least one blank area 122 are located. The at least one blank area 122 is surrounded by the at least two embossed areas 121. Each display portion 123 is located in each of the at least one blank area 122.

Figure 10:
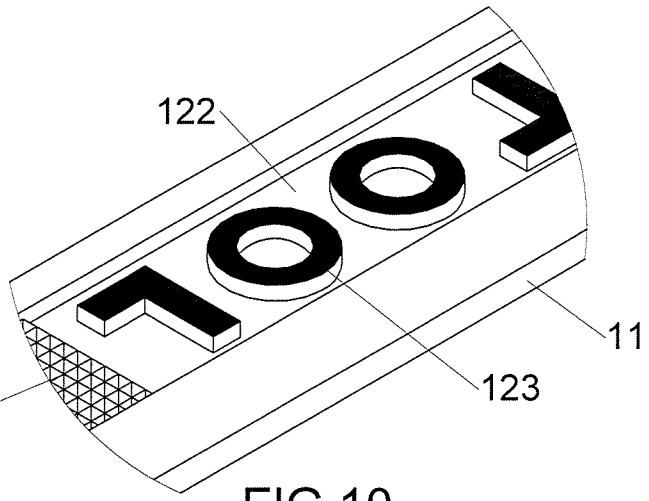
FIG. 10 is an enlarged view of the circled area "A" in FIG. 9.
Figure 9:
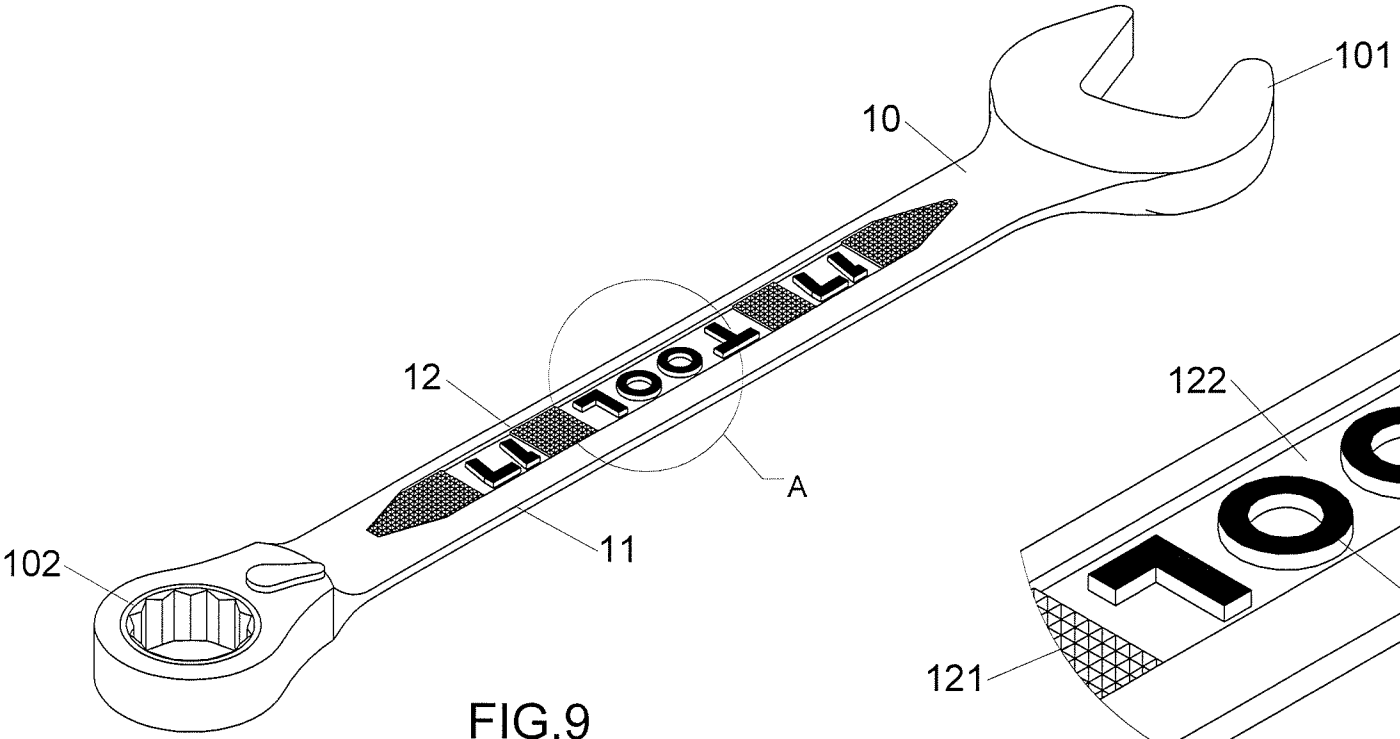
FIG. 9 shows the fifth embodiment of the display structure of the present invention.
Figure 11:
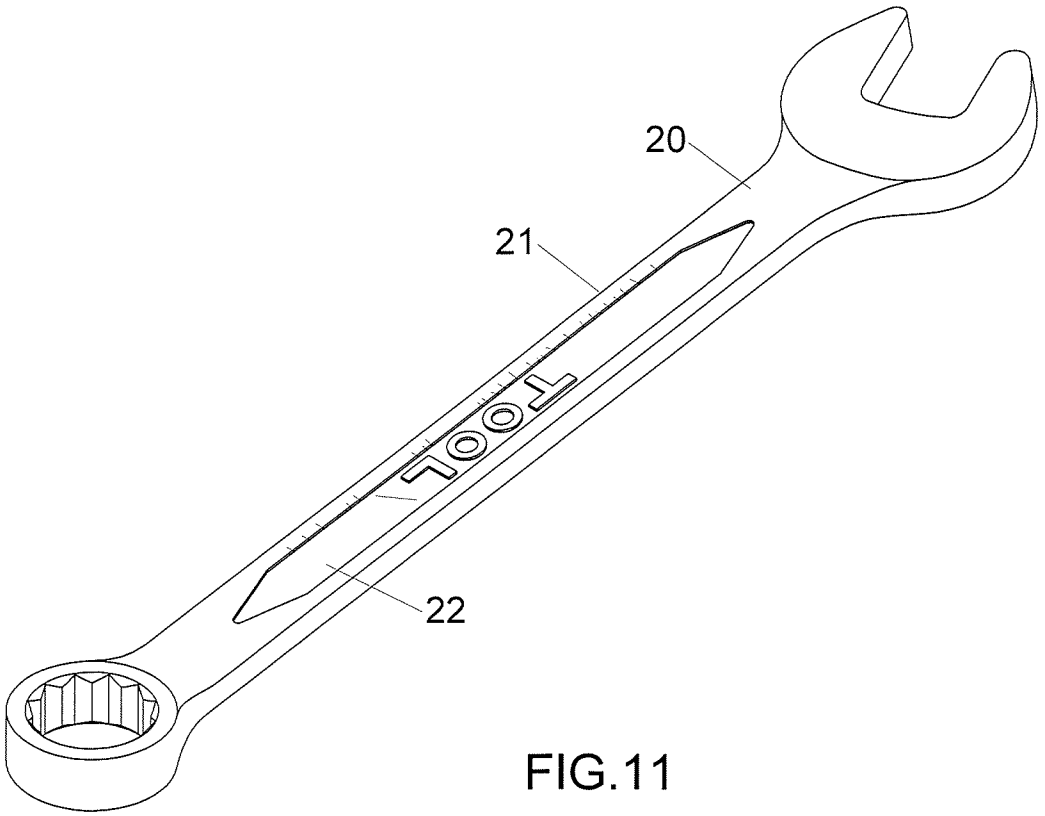
FIG. 11 shows a conventional display structure of a wrench.

FIGS. 9 and 10 show that the second function end 102 is a ratchet wrench head.

The advantages of the present invention are that the display area 12 has the embossed areas 121 which have protruded portions or bosses, and the display area 12 also has the display portions 123 which has colored areas formed on the top thereof. The color of the display portions 123 is different from that of the body 10 to provide better distinguishable feature.

The wrench may have the mirror face with the embossed areas 121 and the display portions 123, or the wrench may have the matte face with the embossed areas 121 and the display portions 123.

The wrench may have the mirror face with the embossed areas 121, the blank areas 122 and the display portions 123, or the wrench may have the matte face with the embossed areas 121, the blank areas 122 and the display portions 123.

The display areas 12 each have the embossed areas 121 and the blank areas 122, and each of the embossed areas 121 and the blank areas 122 has the display portions 123 which has different colors from that of the body 10 to display the specifications and logos of the wrench.

The display portion 123 may be surrounded by the embossed areas 121, and the display portion 123 has the colored area formed on the top thereof. The display portion 123 is obvious among the embossed area 121.

The present invention may not have the blank areas 122, and the display portions 123 are formed to the embossed areas 121 or the blank areas 122. The color of the display areas 123 is different from that of the embossed areas 121 or the blank areas 122 to provide various visual features.

The user's hand may touch the display area 12 which includes the embossed areas 121 so as to have better grip feature. The user's hand may also hold the area without the display area 12 to use the wrench as using conventional wrenches.

The number of the protruded portions or bosses of the embossed areas 121 is plural so that even if the molding set is dulled, the result for the pressing of the embossed areas 121 is not significantly affected.

While we have shown and described the embodiment in accordance with the present invention, it should be clear to those skilled in the art that further embodiments may be made without departing from the scope of the present invention.

What is claimed is:

1. A display structure for a wrench comprising:

a body having a handle which includes a top face and a bottom face, the top face and the bottom face being a flat face or a curved and protruded face, the top face and the bottom face being a mirror surface or a matte surface, the handle having at least one display area which is a recessed area in which at least two embossed areas and at least one blank area are formed, the at least one blank area located between the at least two embossed areas, a top of each of the at least two embossed areas being not higher than the top face and the bottom face of the body, the at least one blank area located at a central portion of the at least one display area, a top of the at least one blank area being lower than the top of each of the at least two embossed areas, and the top face and the bottom face of the body, at least one display portion being formed within the at least one display area, a color of the at least one display portion being different from that of the body, the at least one display portion having a colored area formed on a top thereof, the color area of the at least one display portion being in flush with or being higher than the top face and the bottom face of the body, the colored area being formed by way of painting, transfer-printing, printing, applying fluorescent agent or laser carving, the at least one display portion being in a form of characters, logos, digits or patterns, the top of the at least one display portion being higher than the top of each of the at least two embossed areas.

2. The display structure for a wrench as claimed in claim 1, wherein a first function end and a second function end are respectively formed on two ends of the handle.

3. The display structure for a wrench as claimed in claim 2, wherein the first function end and the second function end each are a box end.

4. The display structure for a wrench as claimed in claim 1, wherein the at least one display portion is located in the at least one blank area.

5. The display structure for a wrench as claimed in claim 1, wherein the at least one display portion is located in each of the at least two embossed areas.

6. The display structure for a wrench as claimed in claim 1, wherein the at least two embossed areas cover up the at least one display area and fill the display area, there are multiple display portions which are located spaced-apart from each other and are located on the at least two embossed areas, each of the display portions has the colored area formed on the top thereof.

7. The display structure for a wrench as claimed in claim 1, wherein the at least one display area includes four embossed areas and three blank areas, each blank area is located between two of the embossed areas, there are multiple display portions and each of the blank areas has at least one of the display portions located therein.

8. The display structure for a wrench as claimed in claim 1, wherein there are multiple display areas which are spaced apart from each other and located on the handle, each of the display areas is an elongate recess in which the at least two embossed areas and at least one blank area are located, the at least one blank area is surrounded by the at least two embossed areas, each display portion is located in each of the at least one blank area.

9. The display structure for a wrench as claimed in claim 1, wherein there are three display portions, one of the three display portions is located in the at least one blank area and has the colored area formed on the top thereof, two of the three display portions are located in the at least two embossed areas and do not have the colored area formed on the top thereof.

* * * * *